US008580186B2

(12) United States Patent
Hymas et al.

(10) Patent No.: US 8,580,186 B2
(45) Date of Patent: Nov. 12, 2013

(54) FLOW CONTROL APPARATUS FOR MOLTEN METAL

(75) Inventors: Jason D. Hymas, Fairfield, WA (US); Eric W. Reeves, Hayden Lake, ID (US); John Steven Tingey, Rathdrum, ID (US)

(73) Assignee: Novelis Inc., Toronto (CA)

( * ) Notice: Subject to any disclaimer, the term of this patent is extended or adjusted under 35 U.S.C. 154(b) by 292 days.

(21) Appl. No.: 13/066,486

(22) Filed: Apr. 14, 2011

(65) Prior Publication Data

US 2011/0253753 A1 Oct. 20, 2011

Related U.S. Application Data

(60) Provisional application No. 61/342,868, filed on Apr. 19, 2010.

(51) Int. Cl.
*B22D 41/00* (2006.01)

(52) U.S. Cl.
USPC ..... 266/196; 222/594

(58) Field of Classification Search
USPC ..... 266/196, 236; 222/594, 602
See application file for complete search history.

(56) References Cited

U.S. PATENT DOCUMENTS 608,143 A 7/1898 Killeen
2,348,521 A 5/1944 Carter et al.
4,390,169 A 6/1983 LaBate
5,162,093 A 11/1992 Fournier et al.
5,173,243 A 12/1992 Laszlo
5,674,426 A * 10/1997 Schmid et al. ..... 222/602
6,960,317 B2 * 11/2005 Dussud et al. ..... 266/236
2008/0163999 A1 7/2008 Hymas et al.

OTHER PUBLICATIONS

U.S. Appl. No. 12/928,354, filed Dec. 8, 2010, Reeves et al.
U.S. Appl. No. 12/928,355, filed Dec. 8, 2010, Reeves et al.
U.S. Appl. No. 12/928,356, filed Dec. 8, 2010, Reeves et al.
U.S. Appl. No. 12/928,353, filed Dec. 8, 2010, Boorman et al.
U.S. Appl. No. 13/066,474, filed Apr. 14, 2011, Reeves et al.

* cited by examiner

*Primary Examiner* — Scott Kastler
(74) *Attorney, Agent, or Firm* — Kilpatrick Townsend & Stockton LLP

(57) ABSTRACT

Exemplary embodiments of the invention relate to a flow control apparatus for control of molten metal flow through a trough. The apparatus includes a flow control element (e.g. a movable dam or flow restrictor) movable between an operating position and an inactive position. A guide element provides an elongated track having a first part extending generally parallel to the longitudinal axis of the flow control element. One or more track followers are retained by the guide element and are movable along the track. An elongated arm is attached at one end to the flow control element and to the track follower at an opposite end. An actuator operably connects to the track follower to move the track follower along the track. The track causes the flow control element to move away from the operating position with a straight (non-pivoting) motion, but preferably causes the flow control element to pivot as it approaches the inactive position. The flow control apparatus may be combined with a connector unit for connecting sections of a metal-conveying trough or the like, or may be used directly with such trough or trough sections.

27 Claims, 5 Drawing Sheets

25
21
31
30
22
45
20
33
44
34
47
24
37
50
36
13
40
17
42
42A
43
15′
42B
16′
53
18′
52
53
53
19′
19′

FLOW CONTROL APPARATUS FOR MOLTEN METAL

CROSS-REFERENCE TO RELATED APPLICATION

This application claims the priority right of prior co-pending U.S. provisional patent application Ser. No. 61/342,868 filed on Apr. 19, 2010 by Applicants named herein. The entire contents of provisional patent application Ser. No. 61/342,868 are specifically incorporated herein for all purposes.

BACKGROUND OF THE INVENTION (1) Field of the Invention

This invention relates to the control of flowing molten metal passing, for example, through molten metal troughs, runners, channels, or the like. More particularly, the invention relates to movable flow control elements.

(2) Description of the Related Art

Molten metals used in industry are often transferred from one location to another through an open trough, runner or channel (referred to simply as a "trough" in the following description), or they may be transferred directly from one furnace to another. During such transfer, it is often necessary to interrupt, divert or slow the flow of molten metal. For example, aluminum or aluminum alloys may be melted in a metal melting furnace and transferred through a series of troughs to casting apparatus for producing cast ingots or other products, and a molten metal dam is sometimes arranged within the trough so that the metal flow can be shut off, or so that a section of the trough can be drained for inspection or repair, or so that the section of trough can be replaced or the trough extended. At other times, it may be necessary to isolate a body of molten metal in a channel or section of a trough, but to allow a small amount of metal to escape in order to maintain a desired temperature in the main body of metal. Such an arrangement is referred to as a bottom bleed system and amounts to a dam that terminates a small distance above the bottom of a trough or channel. Devices of this kind, and others, may be referred to generally as movable flow control elements and they may include molten metal gates, dams, shutters, plugs, stoppers, and the like.

Movable flow control elements of this kind, when used with a trough, are typically mounted on a fixed frame or gantry that straddles the trough. An actuating device, e.g. a motor, for moving the element into or out of the trough is mounted on a horizontal cross-member of the frame and is provided with controls so that the element can be moved up or down when, and to the extent, required, e.g. to start or stop the metal flow. The element itself is generally made of a rigid refractory material, e.g. metal or ceramic, having a shape similar to that of the cross-section of the trough and may be provided with a layer or bead of compressible material around its edges to create a seal to prevent metal penetration when the element is in the closed position. There are, however, several problems with this kind of arrangement. For example, because the frame straddles the trough, and usually has a cross-member linking both sides, it causes difficulties of access to the trough interior when cleaning or maintenance is required. Furthermore, the actuating device is exposed to heat and vapors from the metal trough, which may shorten its active life, and may cause danger or discomfort for workers carrying out maintenance or repairs on the device. Additionally, the extent by which the element may be removed from the trough is often limited, so that access to it for maintenance or repair is difficult. There is therefore a need for an improved arrangement to overcome or at least to minimize some or all of such difficulties.

U.S. Pat. No. 5,162,093 which issued on Nov. 10, 1992 to Fournier et al. discloses a device for opening and closing a vessel containing molten metal. In this case, the device includes a conical stopper that forms a removable plug in a drain hole provided in a sidewall of a metal holding vessel, e.g. a furnace or ladle, at or near the bottom of the vessel. The plug is attached to a pair of rotatable arms mounted on the side wall that allow the stopper to be moved into and out of the drain hole as required. The arms are pivotably attached to the plug and to the side wall to guide the plug in fixed path such that it initially moves approximately axially of the drain hole, and then later moves in a curved path away from the drain axis. This motion is reversed when the plug is returned to the bore to stop the metal flow.

U.S. Pat. No. 4,390,169 which issued to Michael D. LaBate on Jun. 28, 1983 discloses a gate positioned within a metal runner. The gate is attached to a lifting device that allows the gate to be raised or lowered. The lifting device includes an arm pivotally attached to an upright post at one side of the runner and having a suspended weight at the other side of the trough. The gate is raised or lowered manually a handle or via a rope.

U.S. Pat. No. 2,348,521 which issued to Carter et al. on May 9, 1944 also discloses a gate for a molten metal runner. The gate is attached to a centrally pivoted arm that extends beyond one side of the runner and is provided with a weight at the far end. The weight is located within a housing and is held in an upper position by a latch when the gate is in the closed position. When the latch is released, the weight falls freely in the housing for a time to take up slack, and then lifts the gate with a jerking action as the slack plays out.

U.S. Pat. No. 608,143 which issued to Michael Killeen on Jul. 26, 1898 discloses a skimmer movably positioned within a molten metal skimmer trough. The skimmer is attached to a lever that is pivoted in the center and extends to one side of the trough. The skimmer may be manually raised or lowered simply lowering or raising the free end of the lever.

BRIEF SUMMARY OF THE INVENTION

One exemplary embodiment of the invention provides a flow control apparatus for control of molten metal flow, e.g. through a trough or trough section. The apparatus includes a flow control element having opposed ends and a longitudinal axis extending between the opposed ends, and the element is movable between an operating position and an inactive position. A guide element includes an elongated track having a first part extending generally parallel to the longitudinal axis of the flow control element. At least one track follower is retained by the guide element and is movable along the track. An elongated arm is attached to the flow control element adjacent one end of the arm and attached to the at least one track follower adjacent an opposite end of the arm. An actuator operably connected to the at least one track follower is provided to move the at least one track follower along the track.

The flow control element is preferably in the form of a dam shaped to fit within a generally U-shaped open-topped channel for blocking or restricting flow of molten metal through the channel. By the term "U-shaped" we mean a channel that, in vertical cross-section, is open at the top and has side walls that may be vertical or sloping somewhat from the vertical, and a bottom that may be flat or curved. The side walls may in some cases have different angles of slope at different heights.

Any similar shape that will serve to contain and convey molten metal and has an open top should be sufficient to satisfy this terminology.

In the apparatus, the track preferably has a second part that curves away from the longitudinal axis of the flow control element, thereby causing the arm and attached flow control element to pivot as the flow control element approaches the inactive position.

The flow control element, which may be, for example, a dam or flow restrictor, preferably has a solid core and an external cover, that may be removable from the core, made of a compressible material that resists attack by molten metal.

The guide element is a unit that supports or defines a track in one form or another, and is preferably compact and hollow so that an actuator may be positioned inside the guide element. The element is most preferably in the form of an upstanding post provided with a slot forming the elongated track. The post may be positioned at one side only of a metal-conveying trough or a connector unit for metal-conveying troughs and preferably occupies as little lateral space as possible because floor space around a metal-conveying trough is often limited and is required for other equipment. A track follower is any kind of element whose motion is constrained to move along the track of the guide element. Clearly, it is preferably "trapped" by the track so that it cannot become disengaged from the track. There is at least one track follower and each is preferably in the form of a rod extending through a slot in the guide element that forms the track. The free ends of the rods protrude out of opposite sides of the slot, the free ends are connected to the arm adjacent the opposite end thereof. The free ends are preferably attached to the opposite end of the arm via a carriage that is movable along the guide element and that serves to hold together two or more of the rods as they slide along the track.

The actuator is a device that moves the track follower(s) along the track in one direction and then the other so that the flow control element can be moved between the operating and inactive positions as desired. The actuator may be of any suitable kind, but is preferably a hydraulic or pneumatic piston/cylinder device that is positioned with the cylinder thereof within a hollow interior of the guide element.

The flow control element is preferably releasable from the elongated arm and is preferably adjustable to allow for minor relative changes of position.

The guide element is preferably oriented vertically, and the elongated arm is oriented horizontally when the flow control element is in the operating position. The apparatus preferably operates from one side only of a trough or connector unit, thereby occupying minimal space. The track guides the flow control element out of a channel initially without pivotal motion, but may pivot the flow control element about the opposite end of the support arm when the flow control element has cleared the channel.

Another exemplary embodiment provides a flow control device for attachment to one or more molten metal flow guides, the device comprising apparatus as described above in operable association with, and preferably attached to, a connector unit having an open-topped (preferably generally U-shaped) refractory lining defining a channel for conveying molten metal through the unit, the channel being shaped and positioned to receive the flow control element therein when the element is moved to the operating position. The flow control element preferably has a corresponding shape that causes the flow control element to block the channel when the flow control element is in the operating position.

The connector unit preferably has a transverse end plate at each longitudinal end through which the channel extends.

The flow control apparatus is positioned at one longitudinal side of the connector unit with the arm extending above the connector unit from the one longitudinal side thereof but terminating short of an opposite longitudinal side of the trough.

Another exemplary embodiment provides an assembly of a flow control apparatus as described above and a trough for conveying molten metal, wherein the flow control element of the apparatus seats within the trough when in the operating position and is moved out of the trough when in the inactive position.

The flow control element is preferably a molten metal dam shaped and dimensioned to fit within, and to block molten metal movement through, the molten metal trough when in the operating position seated within the trough. The guide element is preferably positioned adjacent to the trough and is fixed thereto, and the flow control apparatus is preferably positioned at one longitudinal side of the trough and the arm extends above the trough from the one longitudinal side but terminates short of an opposite longitudinal side of the trough.

According to another preferred exemplary embodiment of the present invention, there is provided a flow control apparatus for control of molten metal flow through a trough. The apparatus has a flow control element with opposed ends and a longitudinal axis extending between the opposed ends, and the element is movable between an operating position to an inactive position. A guide element is provided, including an elongated track provided with a curved section at one end and a straight section extending from an opposite end of the track to the curved section, and at least one track follower is retained by the guide element and is slidable along the track. An elongated arm extends laterally of the flow control element, the arm being attached to the flow control element adjacent one end of the arm and attached to the at least one track follower adjacent an opposite end of the arm. An actuator in the form of a motor is operably connected to the guide element to move the at least one track follower along the track. The track is positioned with the straight and curved sections oriented to cause the flow control element to move initially in a direction parallel to the axis for a distance corresponding generally in length to the straight section, as the flow control element moves away from the operating position, while causing the flow control element to partially rotate as the flow control element approaches the inactive position.

In the exemplary embodiments, the parts of the flow control apparatus are located within the trough (i.e. the flow control element itself) or on one longitudinal side of the trough. The other side of the trough preferably remains unobstructed by any parts of the flow control apparatus, thereby providing an attendant or operator with free access to the trough from the unobstructed side. Furthermore, by preferably making the first part of the track vertically upright, the apparatus may be made compact in terms of their horizontal extent away from the side of the trough, and any desired amount of exclusively vertical travel of the flow control element may be provided simply by lengthening the straight upright part of the track.

The flow control element may be in the form of a dam for completely blocking the flow of molten metal through a channel, or it may be in the form of a flow restrictor that reduces, but does not eliminate, the rate of flow of the molten metal. A flow restrictor may be an element having one or more through holes of restricted area so that the molten metal is forced to flow through the holes, or it may be in the form of a weir, i.e. a short blocking element over which molten metal may flow.

It should be noted that, in this specification, the term "trough section" includes in most cases the term "trough" since a single trough section may sometimes be used alone and is then the functional equivalent of a "trough".

BRIEF DESCRIPTION OF THE SEVERAL VIEWS OF THE DRAWINGS

Exemplary embodiments of the invention are described in detail in the following with reference to the accompanying drawings, in which.

DETAILED DESCRIPTION OF THE EXEMPLARY EMBODIMENTS

Figure 1:
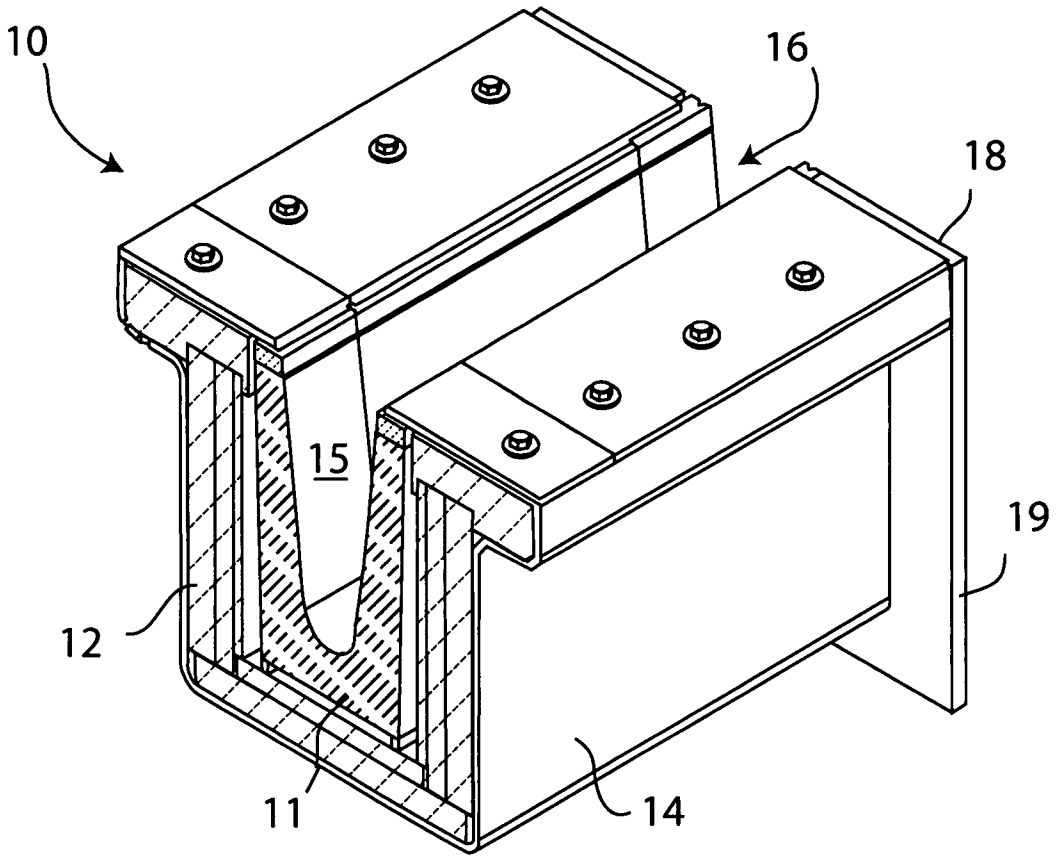
FIG. 1 is a perspective view, partly in cross-section, of an example of a section of a trough which may be used with a flow control apparatus to form an exemplary embodiment of an assembly according to the invention.

FIG. 1 shows an example of a part of a section 10 of a molten metal trough that may be used in an assembly according to exemplary embodiments of the invention. The trough section 10, which may be of any suitable length, has an elongated refractory trough lining 11 preferably made of a ceramic material that is resistant to heat and to attack by molten metal. The refractory lining 11 is partially surrounded by heat insulating material 12, e.g. refractory boards, and is enclosed within and protected by an outer metal housing 14 or shell. The lining 11 has an inner surface 15 forming a U-shaped open-topped channel 16 that, in use, holds molten metal up to a certain working height (e.g. half the depth of the channel) and normally conveys the molten metal through the channel from one end of the trough section to the other. The trough section 10 has an end 18 provided with a transverse metal end wall 19 that may support the trough section 10 on or above a foundry floor (not shown) or other support. The end 18 may be connected either to another similar trough section, to extend the trough in length, or to equipment for supplying or utilizing molten metal, e.g. a metal melting furnace or a casting apparatus (not shown), or to a trough connector unit as will be described in more detail below. Although not shown, the other end of the trough section 10 may also have a metal end wall substantially identical to wall 19.

Figure 2:
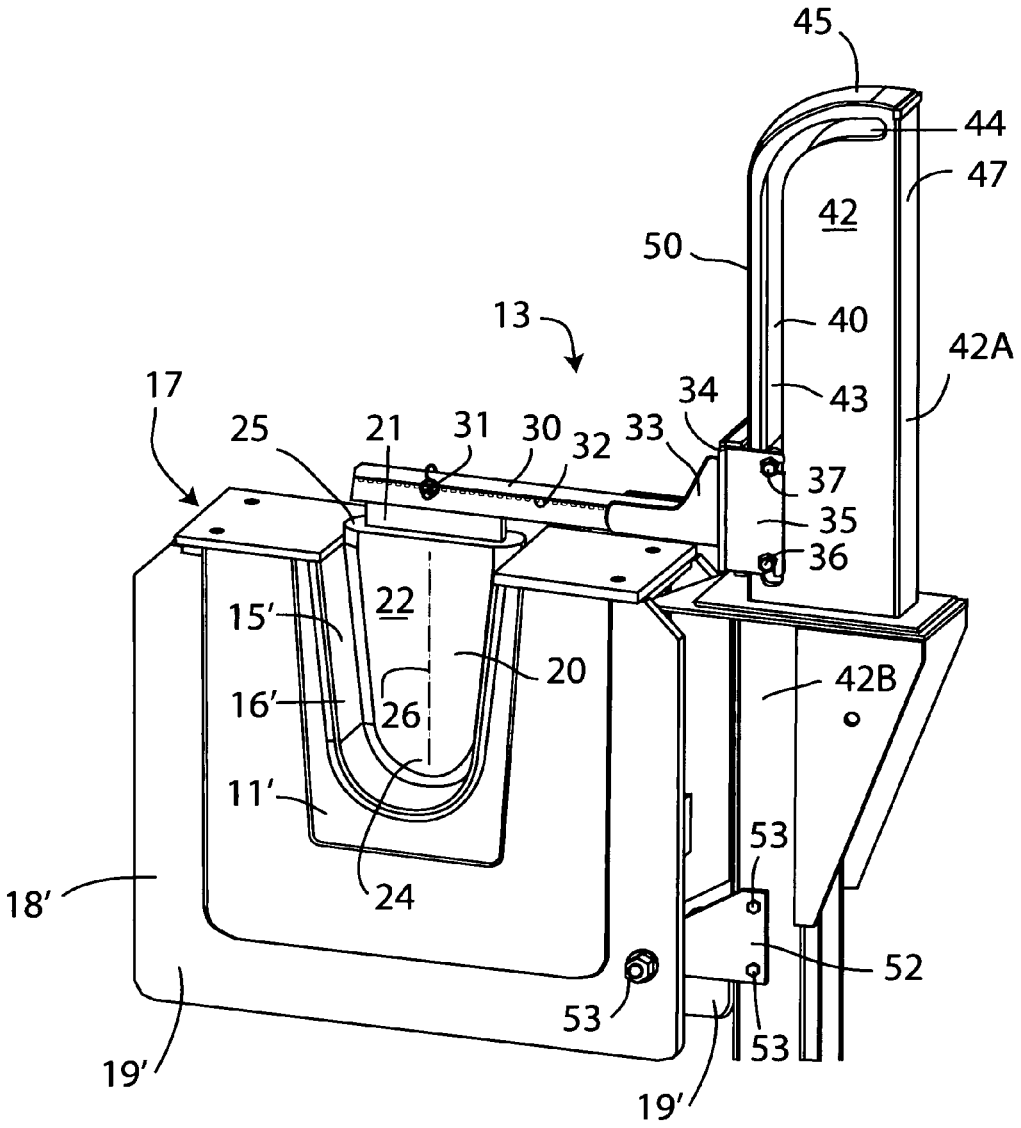
FIG. 2 is a perspective view of one exemplary embodiment of an assembly of a trough and flow control apparatus, showing the flow control element in a lowered, operating position and showing only an end region of the trough.
Figure 3:
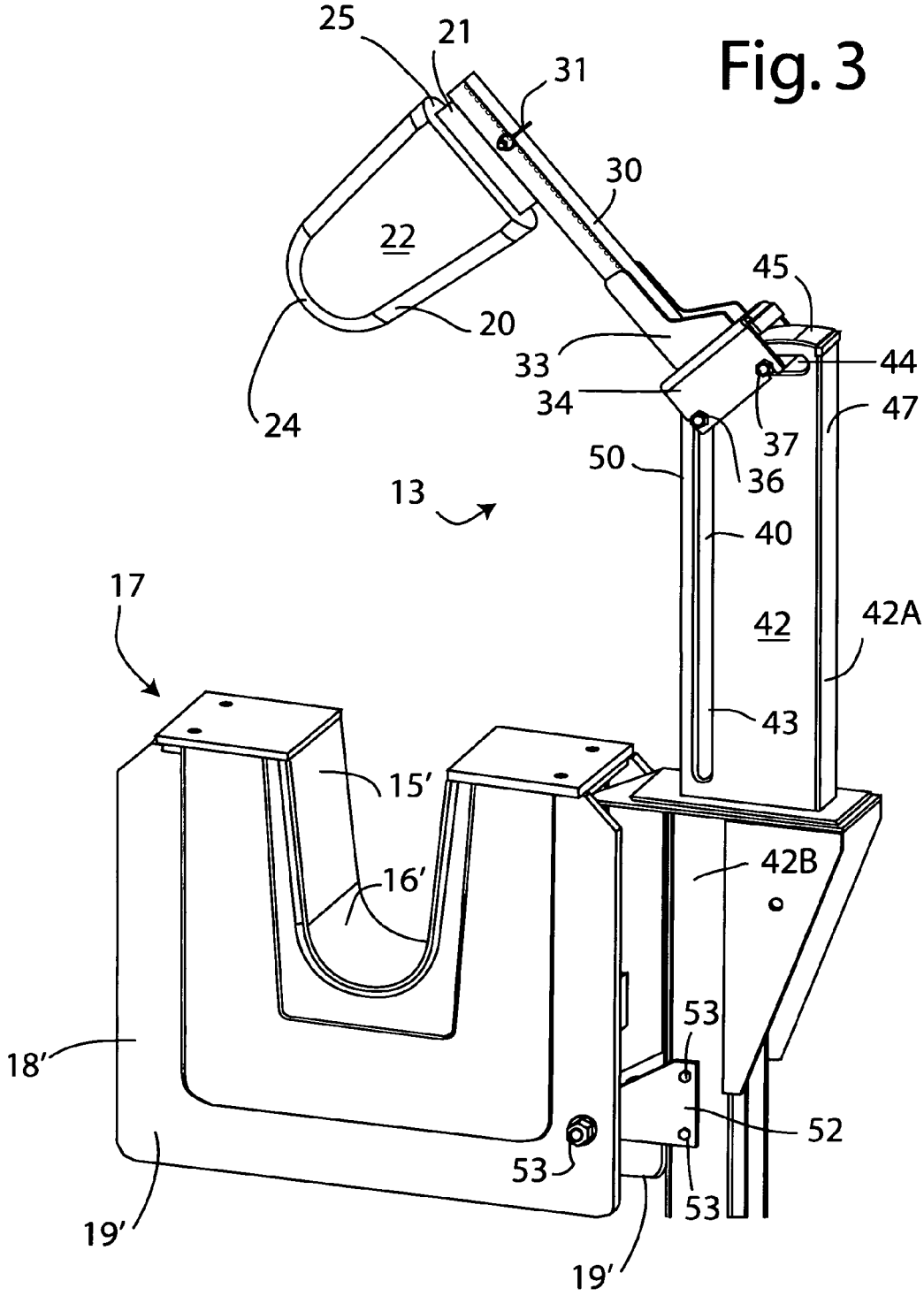
FIG. 3 is a view similar to FIG. 2 but showing the flow control member element in a raised, inactive position.

FIGS. 2 and 3 of the drawings show an exemplary embodiment of a molten metal flow control device which may be used with the trough section 10 of FIG. 1 or a similar trough section. FIG. 2 illustrates an apparatus that includes a short trough connector unit 17 and a flow control apparatus 13 that functions in conjunction with the trough connector unit.

The trough connector unit 17 may be attached between two trough sections 10 of the kind illustrated in FIG. 1, e.g. by attachment (such as by bolting) to the end plates 19 of two adjacent and mutually aligned trough sections, and may be attached to the underlying floor (not shown) e.g. by being bolted down. The trough connector unit 17 resembles a very short version of the trough section 10 of FIG. 1 in that it has a refractory lining 11' of similar shape and size to the lining 11 of FIG. 1, an outer metal shell (not visible) surrounding the lining 11' and a pair of transverse metal end walls 19' at each end 18' of the unit. The refractory lining 11' defines a short U-shaped open-topped channel 16', having an inner surface 15', that extends between the end walls 19' and has outer ends that are generally flush with the outer surfaces of the end walls 19'. A molten metal dam 20, which acts as a metal flow control element, is positioned within the channel 16' to block the channel against molten metal flow therethrough. In consequence, molten metal (not shown) is held back behind the dam 20 within the channel 16' of the connector unit 17 and channel 16 of an adjacent trough section 10. The dam 20, which is shaped and dimensioned to fit snugly in the channel 16' to prevent metal leakage past the dam, is made of a metal core 21 surrounded by a cover 22 (sometimes referred to as a "sock") made of compressible heat-resistant material that is also resistant to attack by metal, e.g. a vacuum-formed refractory fiber-type material. The cover 22 is preferably easily removable from the metal core 21 so that it can be replaced if or when it becomes worn or damaged. For example, it may have a simple slip-fit design intended to slip over the thin core and remain in place due to friction. The compressible characteristics of the cover allow the edges of the cover to fit exactly against the surface 15' even if the latter has minor irregularities or defects that might otherwise lead to metal leakage. To allow for such compression, the metal core 21 itself is spaced slightly away from the surfaces of the channel 16', e.g. by an amount of up to 25 mm or so. The sock thickness is then made more than this amount, so that the desired compression takes place as the dam is moved into position. The compressible cover also prevents the dam 20 from causing damage to the refractory lining 11'.

In FIG. 2, the dam 20 is shown in its operating (lowermost or closed) position, a position which is considered to be the operating position because, in this position, the dam 20 operates to prevent metal flow through the connector unit 17. The dam 20 has longitudinally opposed ends 24 and 25 and a central axis 26 that, in this view, is generally vertical. Lower end 24 contacts the bottom of the channel 16' and the molten metal therein, whereas upper end 25 is positioned slightly above the channel and remains out of contact with molten metal at all times.

The dam 20 is connected at its upper end 25 to an elongated support arm 30 that extends transversely of the channel 16 towards one longitudinal side of the connector unit 17 and, in the position shown in FIG. 2, is horizontal and arranged at right angles to the longitudinal direction of the channel (direction of metal flow). The arm 30 clears the top of the trough connection unit 17 by a small distance so that its movements are not impeded by the trough. The attachment between the dam 20 and the arm 30 is preferably rigid, although optimally the dam may be easily releasable from the arm so that either part may be removed for maintenance or replacement. For example, if the apparatus is to be used with troughs or connector units of different internal sizes, it would be necessary to make the dam replaceable and to provide several dams of different sizes to fit the different channels. In the illustrated embodiment, the arm 30 has an inverted U-shape in cross-section, thereby forming an inverted channel just wide enough to trap the upper end of the metal core 21 of the dam 20 and to hold it firmly. The dam is releasably retained in the channel by a pin 31 that passes through holes in the sides of the arm 30 and the core 21 so that the core cannot slide along the channel or drop out. The arm 30 is preferably provided with a row of holes 32 that make it possible to move the dam from one longitudinal position on the arm to another by choosing a suitable hole for pin 31. This allows the dam to be positioned accurately within channel 16'.

At its opposite end, the arm 30 is held securely within and supported by a metal cradle 33 that is rigidly attached to a movable carriage 34. The carriage has side pieces 35 that connect to elongated rods 36 and 37, made of metal or tough plastics material, that extend through an elongated slot 40 in an upstanding post 42. The slot and upstanding post together act as a guide element for the dam 20 in that the slot 40 functions as a track to guide and define movements of the carriage 34 and rods 36, 37 (which therefore functions as a track follower), and thereby to guide movements of the arm 30 and the attached dam 20. To reduce friction, the rods 36 and 37 have external sleeves provided with internal bearings so that the sleeves are able to rotate around the rods as the rods move along the slot 40. The rods 36 and 37 slide along the slot while fitting snugly therein to prevent undue play or lateral movement between the carriage 34 and the slot. As shown, the slot 40 has a first part 43 close to the connector unit 17 that is generally straight and a second part 44 more remote from the connector unit 17 that is curved. The first (straight) part 43 extends vertically upwardly from a point above the upper level of the trough connector unit 17 to a point near a top 45 of the post 42. The second (curved) Oft 44 commences from this point to the top of the post 42 at a point near a rear wall 47 thereof. The post 42 has a front wall 50 with a shape that mimics the path of the slot 40, i.e. it is vertical for most of its length, but curves to the rear adjacent the top 45 of the post. The carriage 34 and rods 36 and 37 slide smoothly and accurately along the front wall 50 and the track formed by the slot 40. Such movement is controlled by an actuator positioned within the post 42, as will be described more fully later.

The post 42 is made up of an upper section 42A and a lower section 42B that are bolted together (see FIGS. 4 and 5) and the post 42 is attached to end walls 19' of the connector unit 17 by flanges 52 and bolts 53. However, as an alternative, the lower section 42B of post 42 may be free-standing, e.g. it may be provided with a base (not shown) that rests on (or is fixed to) the floor, as long as the degree of support is such that the post 42 has no tendency to move while the flow control device is being operated and provides rigid support for the dam 20.

As noted, in the view shown in FIG. 2, the dam 20 is in the operating (closed or lower) position and it effectively blocks the flow of molten metal along the connector unit 17 and attached trough sections 10 at this point. However, as the dam 20 is raised to the open (upper or inactive) position shown in FIG. 3, it is first raised directly vertically upwards, i.e. in the direction of vertical axis 26, due to the movement of the carriage 34 and rods 36, 37 along the straight first section 43 of the slot 40. This entirely vertical movement allows the dam 20 to disengage from the inner surface 15' of the channel 16' and to clear this surface without binding or rigid contact. The required amount of such entirely vertical movement depends on the nature of the trough section (e.g. its depth and shape, etc.), but may be quite a small amount in many cases (e.g. 3-4 inches). After such entirely vertical motion, and as the upper rod 37 enters the curved second part 44 of the slot 40, the support arm 30 begins to tilt upwardly and this also causes the dam 20 to tilt or rotate as it is raised further. This tilting action withdraws the dam further from the upper region of the trough connector unit 17 and allows good access to the channel 16'. Any degree of tilting may be provided, and tilting of about 75° from the horizontal is shown in FIG. 3. The tilting of the dam 20 also exposes the lower end 24 of the dam to an operator positioned on the far side of the trough connector unit 17 opposite to the post 42. The lower end 24 tends to be a region of the dam 20 that typically encounters the most wear and damage, so easy access for inspection and replacement of this part is an advantage. When the dam is in the position shown in FIG. 3, molten metal is free to move through the trough connector unit 17 and the attached trough sections 10 without hindrance. Of course, reversal of the movement of the dam 20 from the position of FIG. 3 to the closed position of FIG. 2, causes reversal of the action previously described. If desired, the dam 20 may be stopped at any point between these two positions, for example if it is desired to introduce the dam 20 only partially into the channel 16' so that metal flow through the trough connector unit 17 is to be reduced but not completely blocked.

Figure 4:
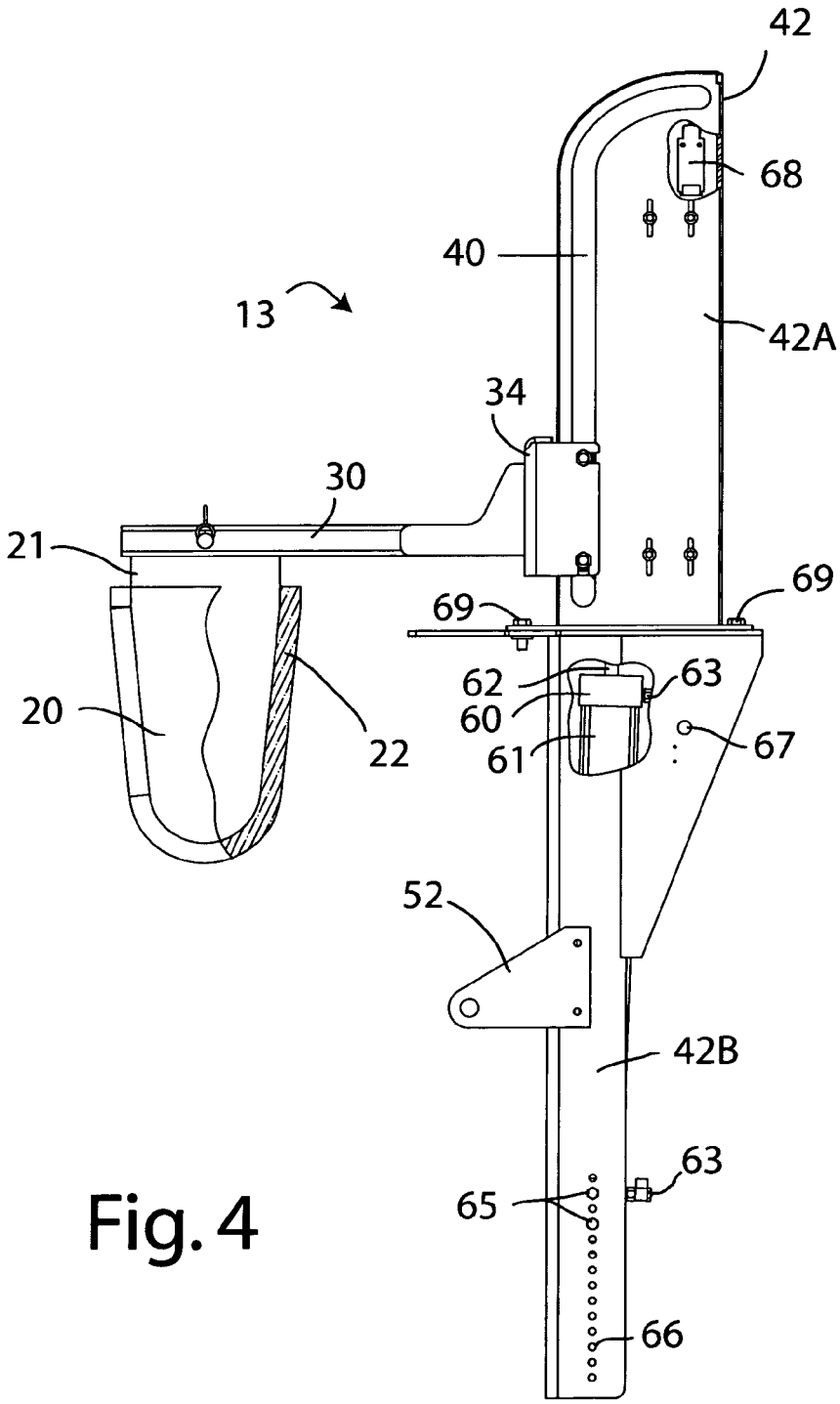
FIG. 4 is a side elevation of the flow control apparatus of FIGS. 2 and 3 shown in isolation having cut-away sections to reveal additional elements.
Figure 5:
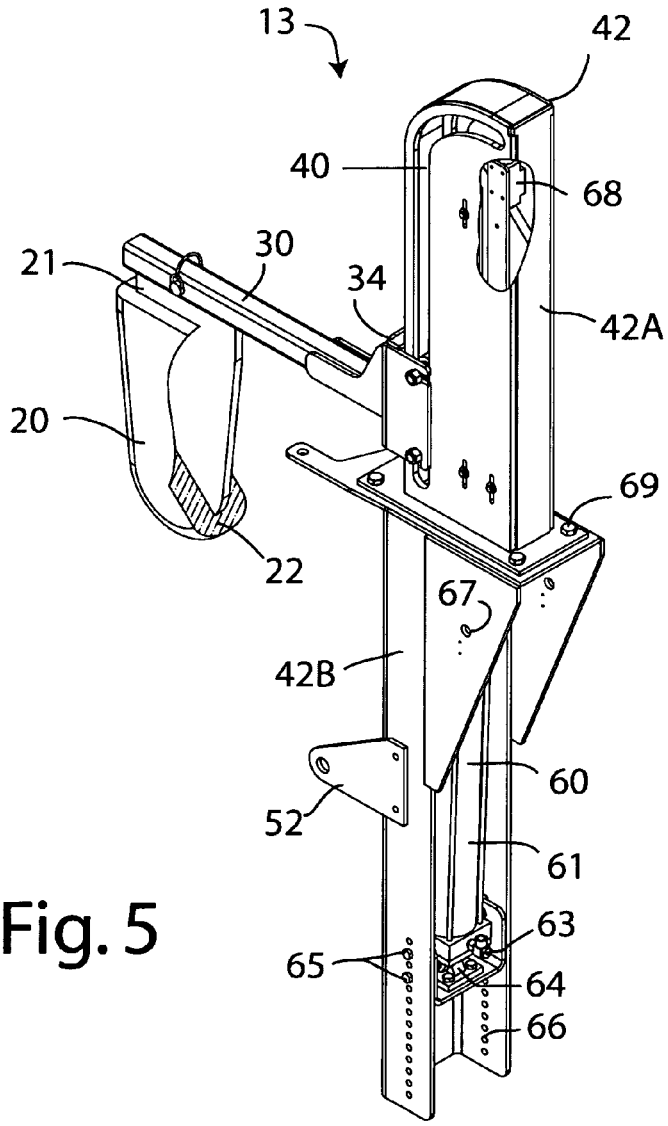
FIG. 5 is a perspective view from the rear of the flow control apparatus of FIG. 4 having cut-away sections to reveal additional elements.

FIGS. 4 and 5 show the flow control apparatus in isolation from the trough connector unit 17. This has been done to reveal more parts of the apparatus, but it should also be noted that the apparatus may be used without the connector unit 17, if desired. For example, the apparatus as shown in FIGS. 4 and 5 may be positioned to one side of a trough section 10 as shown in FIG. 1, with the dam 20 extending into the channel 16 either adjacent to the end of the trough section just inwardly of the end plate 19, or at an intermediate position along the trough section.

As shown in FIGS. 4 and 5, the movements of the carriage 34, and thereby the track follower rods 36, 37, are controlled by a powered actuator 60 positioned within the hollow interior of the post 42. The actuator 60 in this exemplary embodiment is a piston/cylinder arrangement, e.g. a pneumatic or hydraulic motor connected to a source (not shown) of pressurized fluid and controlled by appropriate valves and switches. FIGS. 4 and 5 show couplings 63 used for attachment of pressure hoses to the cylinder. Parts of the actuator 60 are visible through cut-out sections in the post 42 provided for the purpose of illustration (see FIG. 4). The actuator 60 has a cylinder 61 located entirely within the lower section 42B of the post 42 where it is shielded from high temperatures by the side walls of trough connector unit 17 and/or trough section 10. The piston within the cylinder 61 is attached to an extended piston rod 62 projecting from an upper end of the cylinder. The remote end of the piston rod 62 (not visible) is rotatably connected via a linkage (not visible) to an interior part of the carriage 34 (e.g. metal connector piece extending through the slot 40 from the sides of the carriage 34). The linkage allows the carriage to swivel relative to the upper end of the piston rod as the carriage moves into or out of the curved second section 44 of the slot 40. The lower end of the cylinder 61 is attached to the lower post section 42B by a hinged unit 64 (FIG. 5) that allows limited pivoting about a horizontal axis, and the hinged unit is secured by bolts 65 that pass through appropriate holes of vertical rows of holes 66 provided in the lower section 42B to position it at an appropriate height (e.g. at a height that causes the carriage 34 to be at the top end of the slot 40 when the piston rod 62 is fully extended). Extension of the piston rod from the cylinder moves the carriage up along the slot 40 and subsequent retraction of the rod causes the carriage to move down. The upper section 42A of the post 42 also contains limit switches, one of which is shown at 68, that are tripped when the carriage 34 reaches the top and the bottom of its intended range of travel along the slot 40. The limit switches may operate audible or visual signals (e.g. warning lights) to confirm to the operator that the carriage has moved the flow control element to the fully inactive or fully active position. Alternatively, the limit switches may work in cooperation with a motor for the piston/cylinder device to stop the movement of the carriage when the limit switches are tripped.

As previously explained, the movements of the carriage 34 also cause the support arm 30 and the dam 20 to move between the lowered and raised positions of FIGS. 2 and 3. The hinged arrangements of the cylinder 61 and and the actuator rod 62 at the top and the bottom of the actuator 60 also allow the top section 42A of the post 42 to be moved relative to the bottom section 42B (towards or away from the trough connector unit 17 or the trough section 10) by a small amount to allow for proper alignment of the dam 20 with the channel 16' or 16, as mentioned earlier. When proper alignment is achieved, the parts 42A and 42B can be fixed in their relative positions by tightening bolts 69.

The actuator 60 may be operated by a valve or switch (not shown) provided on the outside of the post 42 (e.g. at the position shown by hole 67 in FIG. 4 or FIG. 5) so that an operator may raise or lower the dam 20 when required. Alternatively, the actuator 60 may be under computer control to raise or lower the dam 20 at particular times during a preprogrammed operation of the apparatus.

Preferably, the actuator 60 exerts a downward force on the carriage 34 and thereby the dam 20 when the dam is in the closed (lower position) of FIG. 2 so that the cover 22 is compressed somewhat against the inner surface 15' of the trough connector unit 17 or the inner surface 15 of the channel 16 of the trough section 10. This ensures that the dam 20 forms a good seal with the surface to prevent metal leakage. However, if the dam 20 is made sufficiently heavy, such compression may be accomplished by gravity alone.

FIGS. 4 and 5 also show the cover 22 of the dam 20 partially cut away so that the thickness of the cover and the shape of the underlying metal core 21 can be seen more clearly.

The exemplary embodiments described above are fully effective, but may be modified or altered if desired. For example, while the apparatus of FIGS. 2 and 3 make use of a slot 40 as the track to guide movement of the carriage 34 and the dam 20, any other kind of track may be employed provided the track follower elements are prevented from accidentally departing from the track. For example, the front wall 50 of the post 42 may be provided with an I-beam that follows the contour of the front wall, and the rods 36 and 37 may be replaced by stub axles with rollers than engage under the outer flange of the I-beam.

Furthermore, in still alternative exemplary embodiments, the dam 20 may be modified so that it does not function to completely block molten metal flow through the channel 16' or 16 in its lowermost position, but merely restricts the flow. This may be achieved, for example, by providing the dam 20 with a through hole of restricted diameter so that that metal flows through the hole when the dam is in the lowermost position. Alternatively, the dam 20 may be made much shorter in vertical extent so that, when in the lowermost position, it remains within the confines of the channel 16' or 16 at its upper end so that molten metal may flow over the top of the dam.

While the illustrated embodiments are operated by means of a pneumatic or hydraulic piston and cylinder device, actuators of other kind can be utilized. For example, the movable carriage 34 may be attached to a loop of gear chain that is driven by an electric motor positioned within the lower section 42B of the post 42 and extending over an axle positioned within the upper section 42B near the top of the post. Operation of the electric motor in one direction causes the chain to raise the carriage 34, and operation in the other direction causes it to descend.

All such modifications and variations fall within the scope of the present invention.

What is claimed is:

1. A flow control apparatus for control of molten metal flow, said apparatus comprising:

a flow control element having opposed ends and a longitudinal axis extending between said opposed ends, and said element being movable between an operating position and an inactive position;

a guide element including an elongated track having a first part extending generally parallel to the longitudinal axis of the flow control element;

at least one track follower retained by said guide element and movable along said track;

an elongated arm attached to the flow control element adjacent one end of the arm and attached to the at least one track follower adjacent an opposite end of the arm; and an actuator operably connected to said at least one track follower to move said at least one track follower along said track, and wherein said track has a second part that curves away from the longitudinal axis of the flow control element, thereby causing said arm and attached flow control element to pivot as said flow control element approaches said inactive position.

2. The apparatus of claim 1, wherein said flow control element has a solid core and an external cover made of a compressible material that resists attack by molten metal.

3. The apparatus of claim 2, wherein said external cover is removable from said solid core.

4. The apparatus of claim 1, wherein said guide element is an upstanding post provided with a slot forming said elongated track.

5. A flow control apparatus for control of molten metal flow, said apparatus comprising:

a flow control element having opposed ends and a longitudinal axis extending between said opposed ends, and said element being movable between an operating position and an inactive position;

a guide element including an elongated track having a first part extending generally parallel to the longitudinal axis of the flow control element;

at least one track follower retained by said guide element and movable along said track;

an elongated arm attached to the flow control element adjacent one end of the arm and attached to the at least one track follower adjacent an opposite end of the arm; and an actuator operably connected to said at least one track follower to move said at least one track follower along said track, wherein said guide element is an upstanding post provided with a slot forming said elongated track, and wherein said at least one track follower is at least one rod extending through said slot with free ends protruding at opposite sides of said slot, said free ends being connected to said arm adjacent said opposite end thereof.

6. The apparatus of claim 5, wherein said free ends are attached to said opposite end of the arm via a carriage movable along said guide element.

7. The apparatus of claim 1, wherein the flow control element is in the form of a dam shaped to fit within a generally U-shaped open-topped channel for blocking or restricting flow of molten metal through said channel.

8. The apparatus of claim 1, wherein said actuator is a hydraulic or pneumatic piston/cylinder device.

9. The apparatus of claim 8, wherein said piston/cylinder device is positioned with the cylinder thereof within a hollow interior of said guide element.

10. The apparatus of claim 1, wherein said flow control element is releasable from said elongated arm.

11. The apparatus of claim 1, wherein attachment of said flow control element to said elongated arm is adjustable to allow for minor relative changes of position.

12. The apparatus of claim 1, wherein said guide element is oriented vertically, and said elongated arm is oriented horizontally when the flow control element is in the operating position.

13. A flow control device for attachment to one or more molten metal flow guides, said device comprising an apparatus comprising:

a flow control element having opposed ends and a longitudinal axis extending between said opposed ends, and said element being movable between an operating position and an inactive position;

a guide element including an elongated track having a first part extending generally parallel to the longitudinal axis of the flow control element;

at least one track follower retained by said guide element and movable along said track;

an elongated arm attached to the flow control element adjacent one end of the arm and attached to the at least one track follower adjacent an opposite end of the arm; and an actuator operably connected to said at least one track follower to move said at least one track follower along said track;

said apparatus being in operable association with a connector unit having an open-topped refractory lining defining a channel for conveying molten metal through the unit, said channel being shaped and positioned to receive said flow control element therein when said element is moved to said operating position.

14. The device of claim 13, wherein said connector unit is attached to said apparatus.

15. The device of claim 13, wherein said connector unit has a transverse end plate at each longitudinal end through which said channel extends.

16. The device of claim 13, wherein said channel is generally U-shaped and said flow control element has a corresponding shape that causes the flow control element to block the channel entirely when the flow control element is in said operating position.

17. The device of claim 13, wherein said flow control apparatus is positioned at one longitudinal side of the connector unit and said arm extends above said connector unit from said one longitudinal side thereof but terminates short of an opposite longitudinal side of the connector unit.

18. The device of claim 13, wherein said connector unit has an upper surface and said actuator is at least partially positioned at a vertical level below said upper surface of the connector unit.

19. An assembly of a flow control apparatus for control of molten metal flow and a trough for conveying molten metal, wherein said apparatus comprises:

a flow control element having opposed ends and a longitudinal axis extending between said opposed ends, and said element being movable between an operating position and an inactive position;

a guide element including an elongated track having a first part extending generally parallel to the longitudinal axis of the flow control element;

at least one track follower retained by said guide element and movable along said track;

an elongated arm attached to the flow control element adjacent one end of the arm and attached to the at least one track follower adjacent an opposite end of the arm; and an actuator operably connected to said at least one track follower to move said at least one track follower along said track; and wherein said flow control element of said apparatus seats within said trough when in the operating position and is moved out of said trough when in said inactive position.

20. The assembly of claim 19, wherein said flow control element is a molten metal dam shaped and dimensioned to fit within, and to entirely block molten metal movement through, said molten metal trough when said flow control element is in said operating position seated within the trough.

21. The assembly of claim 19, wherein said guide element is positioned adjacent to said trough and is attached thereto.

22. The assembly of claim 19, wherein said flow control apparatus is positioned at one longitudinal side of the trough and said arm extends above said trough from said one longitudinal side but terminates short of an opposite longitudinal side of the trough.

23. The assembly of claim 19, wherein said flow control apparatus is positioned adjacent to one longitudinal end of said trough.

24. The assembly of claim 19, wherein said flow control apparatus is positioned between longitudinal ends of said trough.

25. The assembly of claim 19, wherein said trough has an upper surface and said actuator is at least partially positioned at a vertical level below said upper surface of the trough.

26. The flow control device of claim 13, wherein said track has a second part that curves away from the longitudinal axis of the flow control element, thereby causing said arm and attached flow control element to pivot as said flow control element approaches said inactive position.

27. The assembly of claim 19, wherein said track has a second part that curves away from the longitudinal axis of the flow control element, thereby causing said arm and attached flow control element to pivot as said flow control element approaches said inactive position.

* * * * *